US005934019A

United States Patent [19]

Rotharmel et al.

[11] Patent Number: 5,934,019

[45] Date of Patent: Aug. 10, 1999

[54] MOUNTING BRACKET FOR SAFETY DEVICE EMPLOYING BEAM PATH

[75] Inventors: Jean-Michel R. Rotharmel, Vernon Hills; Joseph Ergun, Itasca, both of Ill.

[73] Assignee: The Chamberlain Group, Inc., Elmhurst, Ill.

[21] Appl. No.: 08/896,649

[22] Filed: Jul. 18, 1997

[51] Int. Cl.[6] ..... E05F 15/02

[52] U.S. Cl. ..... 49/28; 49/25

[58] Field of Search ..... 49/25, 26, 28; 248/228.7, 300, 546, 231.8

[56] References Cited

U.S. PATENT DOCUMENTS

| | | | |
|---|---|---|---|
| 795,704 | 7/1905 | Jones . | |
| 1,549,142 | 8/1925 | McKenzie et al. . | |
| 1,595,222 | 8/1926 | Butterworth | 248/228.7 |
| 1,669,199 | 5/1928 | Hicks . | |
| 1,803,894 | 5/1931 | Cross . | |
| 1,856,847 | 5/1932 | Gates | 248/231.81 |
| 1,856,948 | 5/1932 | Dolamore . | |
| 1,879,778 | 9/1932 | Venzie | 248/228.7 |
| 2,712,917 | 7/1955 | Flora et al. | 248/73 |
| 3,116,742 | 1/1964 | Seckerson | 131/235 |
| 3,131,447 | 5/1964 | Tinnerman | 248/228.7 |
| 3,193,232 | 7/1965 | Hatcher | 248/231.81 |
| 3,360,151 | 12/1967 | Yznaga | 220/3.9 |
| 3,720,395 | 3/1973 | Schuplin | 248/205 |
| 3,772,742 | 11/1973 | Gigante | 248/231.81 |
| 4,238,098 | 12/1980 | Siegfried et al. | 248/228.7 |
| 4,362,284 | 12/1982 | Bolante | 248/228.7 |
| 5,004,199 | 4/1991 | Suk | 248/228.7 |
| 5,364,051 | 11/1994 | Philpot | 248/300 |
| 5,407,161 | 4/1995 | Mulkeran | 248/231.81 |
| 5,428,923 | 7/1995 | Waggamon | 49/25 |
| 5,695,162 | 12/1997 | DiCastro | 248/231.81 |
| 5,720,398 | 2/1998 | Kump et al. | 248/231.81 |

*Primary Examiner*—Daniel P. Stodola
*Assistant Examiner*—Curtis A. Cohen
*Attorney, Agent, or Firm*—Fitch, Even, Tabin & Flannery

[57] ABSTRACT

A bracket which can be secured to a track for a garage door for mounting an IR receiver/sender to the track and need not be screwed to the framing around the door opening or bolted into the garage floor includes a main web portion with a right angle lip portion attached at one side and a serpentine-shaped spring member attached adjacent to the other side of the web and bent down so as to face the opposite lip member. An IR mounting extension member extends from the side of the web with the spring member with the IR mounting member extending at right angles to the web and in a direction opposite from the spring member and lip member. Retention of the bracket to the track is achieved by the effect of spring loading of the bracket on the exterior of the track, which is snap fit between the serpentine member and the lip portion.

11 Claims, 5 Drawing Sheets

MOUNTING BRACKET FOR SAFETY DEVICE EMPLOYING BEAM PATH

BACKGROUND OF THE INVENTION

1. Field of the Invention

The present invention pertains to mounting of devices, such as garage door sensors, intrusion and motion alarms, which detect a condition by projecting a beam through an area of interest and monitoring the beam to detect the condition of the beam after passing through the area of interest.

2. Description of the Related Art

Over the years, various arrangements have been proposed for the automatic control of garage door operations. In one popular arrangement, a sensor beam is made to travel across the garage door opening, preferably in a direction generally parallel to the garage floor. Passage of the beam across the garage door opening is continuously monitored and if the beam is broken, action is automatically taken by the garage door opener system, usually, either to raise the garage door or to suspend further power-driven operations. The detector beam can be adjusted to a desired height above the garage floor so as to sense the area of activity with which an owner/operator is most concerned. For example, the beam may be located approximately one foot from the floor to ensure that it is broken by all pets and humans, including children, even those of relatively small stature, who may be present in the doorway.

It is frequently desired that the components associated with transmitting and receiving the beam path be located some minimum distance off of the garage floor so as to avoid unnecessary contact with moisture, road salt or other contamination likely to be found in a garage or driveway environment. Further, it is frequently desired that the components associated with transmitting and receiving the detector beam be located indoors, protected from the elements, while being located very close to the garage door since the operation of the garage door is the activity sought to be controlled by the detector beams. Garage doors commonly run in tracks, one of which is located at either side of the doorway. The tracks, when mounted to the doorway, stick out several inches from the doorway into the garage and, accordingly, may present an obstacle to the passage of a detector beam.

Commonly, the detector beam components have been connected to brackets which are attached to the walls of the garage. Such brackets are frequently lag screwed to the studs of the wall parallel to the surface of the door. Such attachment requires location of wall studs and the task of screwing the brackets to the studs at both sides of the door. The brackets also must protrude far enough from the wall so that the tracks on which the garage door travels do not block the beams of the detector beam components. The difficulty of mounting the detector components to the walls adds to the complexity of the assembly of garage door opening systems.

SUMMARY OF THE INVENTION

It is an object of the present invention to provide a convenient mounting for beam detector components, such as those used for detecting operation of a door.

A further object of the present invention is to provide a mounting device of the above-described type which may be quickly and easily fastened to a garage door track without requiring tools or prior intimate understanding of garage door constructions.

Another object of the present invention is to provide a mounting device of adjustable position to thereby direct the beams to pass through virtually any desired area of interest.

Another object of the present invention is to provide a mounting device having a dual mode of attachment, either by a snap fit directly onto a garage door track or screw mounting to a wall or other member of the garage. A related object of the present invention is to provide a mounting device which can be snap fit onto a variety of garage door tracks, without requiring custom modification to the track or the mounting device, and which is symmetric so that two identical mounting devices can be located on either track of a garage door opener system.

Another object of the present invention is to provide mounting arrangements of the above-described type which can be located at the door opening so as to avoid blockage of the beam by components stored within the garage, yet which do not penetrate the interior of the garage door track and which thereby avoid interfering with operation of garage door rollers passing within the track.

A further object of the present invention is to provide a mounting device which is vibration resistant so as to avoid coming loose despite repeated operations of the garage door and so as to hold the beam steady across the garage door opening, even while the garage door is being operated.

These and other objects of the present invention are provided in an infinitely adjustable resilient mounting for garage door safety detector devices comprising a mounting bracket for resiliently mounting a detector device to a garage door track having an outer surface and an elongated cross section with first and second opposed cross-sectional ends, with the first cross-sectional end having a convex curved outer surface, the mounting bracket providing snap-fit engagement with the first and the second cross-sectional ends of the door track. The mounting bracket preferably comprises a sheet metal body struck from a single blank of spring material to define a central web portion located between a base portion and a housing portion. The base portion includes a flange bent from the central web in a first direction, the flange carrying a first barb means for bitingly engaging the outer surface at the second cross-sectional end of the door track. The housing portion includes a leg bent from the central web in a second direction opposite said first direction, and an end portion of said central web cooperating with the leg to form a corner either shrouding or surface mounting the detector device. When used as a shroud, the housing portion defines an opening through which the detector device communicates with another device and said housing portion includes attaching means adjacent the opening for attaching the detector device and to align the detector device with the opening The mounting bracket has a spring seat portion bent from the central web so as to extend in said first direction, and positioned between the housing portion and the base portion so as to overlie the flange. The spring seat portion of the preferred embodiment includes a pair of resilient arms having free ends spaced apart from one another, with a second barb means adjacent each of the free ends, for bitingly engaging the concave outer surface of the first cross-sectional end of the door track as the free ends are deflected away from the central web as the supporting element is wedged between the base portion and the spring seat portion.

DETAILED DESCRIPTION OF THE PREFERRED EMBODIMENT

Figure 5:
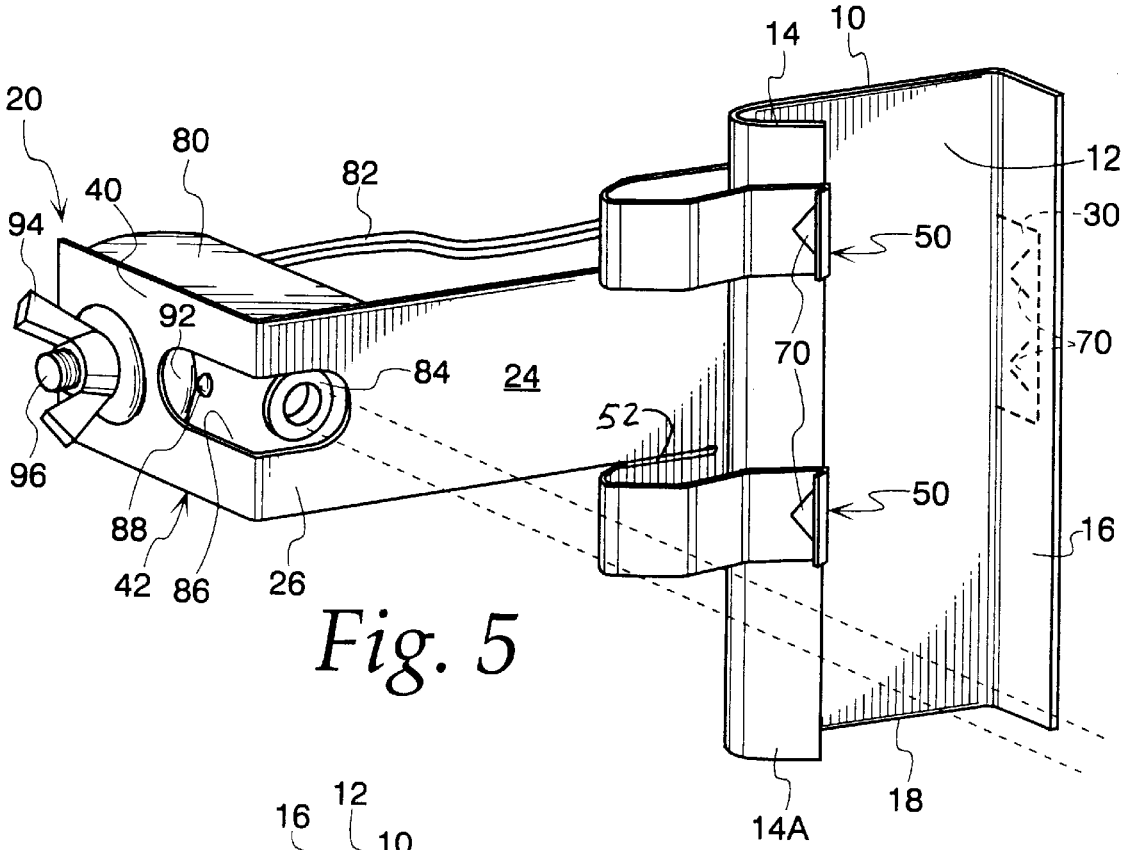
FIG. 5 is a perspective view showing the apparatus mounted on a door-mounting track.

The mounting arrangement according to the principles of the present invention is adapted for use with a variety of differently sized conventional slotted tracks of the kind used to support and guide overhead garage doors. FIG. 5, for example, shows a conventional garage door track 10 having a hollow interior and defining a slot 12 communicating with the hollow interior, formed between a concave gutter or channel portion 14 and a base portion 16. Side wall 18 defines holes (not shown) for receiving fasteners, joining the track 10 to mounting brackets extending from framework surrounding a garage door opening, as is known in the art. Typically, track 10 is arranged such that the base portion 16 faces in a direction closer to the garage door opening while channel portion 14 faces in an opposite direction, toward the garage interior. Accordingly, the side wall 18 is arranged in a direction generally parallel to the path of vehicular movement as vehicles pass through the garage door opening. As will be seen herein, a mounting bracket generally indicated at 20 is spring loaded so as to be clamped about track 10 with a snap-fit action.

Turning now to FIGS. 1–4, bracket 20 is preferably of single piece construction. Although bracket 20 could be formed of molded plastic or composite material, the bracket is preferably stamped from a blank of spring steel material so as to provide several advantages in mounting and protecting sensitive beam sensor devices. In the preferred embodiment, bracket 20 is formed from a blank of 0.040 inch thick 1095 spring material having a hardness ranging between 46 and 50 Rockwell units. The preferred material has a minimum yield of 75,000 psi and a minimum tensile strength of 100,000 psi and an elongation of 9%.

Figure 1:
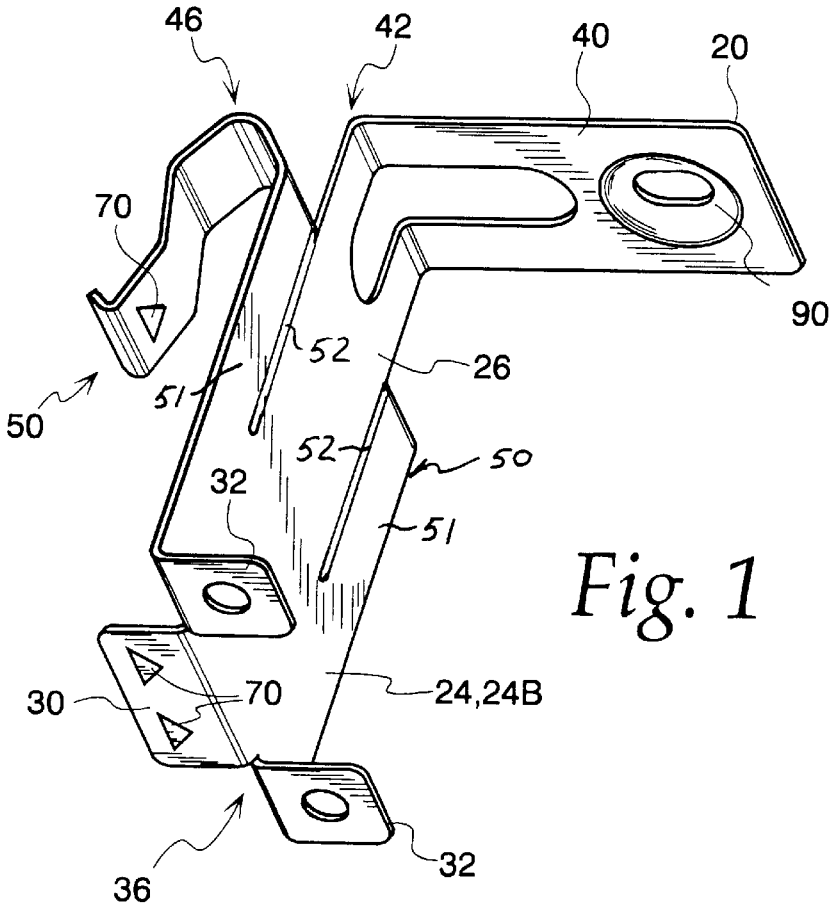
FIG. 1 is a perspective view of mounting apparatus according to the principles of the present invention.

Referring to FIG. 1, bracket 20 includes a web portion 24 which is preferably of flat, planar construction. A web extension 26 preferably comprises a coplanar end portion of main web 24. The main web 24 has a pair of opposed major faces, including a major face 24A facing toward the garage track (see FIG. 3) and a major face 24B facing away from the garage track (see FIG. 1).

As can be seen in FIG. 1, a number of oppositely directed flanges are provided at the base portion, at one end of main web 24. A main flange 30 is bent away from web portion 24, preferably at a right angle, in the direction of major face 24A so as to be positioned to contact one edge of the garage door track. A pair of oppositely directed optional flanges 32 extend in the direction of major face 24B and are provided with apertures for receiving threaded fasteners. Optional flanges 32 are employed when bracket 20 is to be mounted to the garage structure in a manner independent of the garage door track. However, as will be seen herein, the preferred mode of mounting bracket 20 is to affix the bracket to the garage door track with a snap-fit clamping engagement, and in this mode of operation, the optional flanges 32 can be omitted, if desired. Together, the main flange 30 and optional flanges 32, when present, comprise a base portion of the bracket, generally indicated by reference numeral 36.

A leg 40 is bent away from the central web portion 24, preferably at a right angle, so as to extend in the direction of major face 24B, overlying the optional flanges 32. Together, extension 26 and leg 40 comprise a housing portion generally designated by the reference numeral 42. Preferably, the housing portion 42 partly encloses a beam sensor device, shrouding or shielding the beam sensor device from inadvertent contact arising from activity in the garage adjacent the garage door opening. Leg 40 extends away from the garage door track and, customarily, the garage door track is itself inset away from the garage door opening. Accordingly, housing portion 42 of bracket 20 is located away from activity associated with passage through the garage door opening, and is, in this regard, at least partly shielded by the garage track itself.

As mentioned above, main flange 30 is positioned so as to engage a portion of garage door track 10. Bracket 20 further includes a channel seating portion, generally indicated at 46, located opposite main flange 30 and cooperating therewith so as to "trap" or clamp the garage door track with a snap fit, in a manner which will be explained herein. In the preferred embodiment, the channel seating portion comprises a pair of spring members generally indicated at 50. As will be observed in FIG. 1, for example, the spring members 50 have S-shaped portions extending from arms 51 located on either side of extension 26. The arms 51 are separated from extension 26 by slots or cut outs 52 which extend the length of arms 51 and increase their resilience. Preferably, spring members 50 are identical to one another and are spaced apart by extension member 26 so as to be located at opposed edges of bracket 20. The slots 52 could be omitted if reduced resilience of spring member 50 and/or extension 26 is desired.

Figure 3:
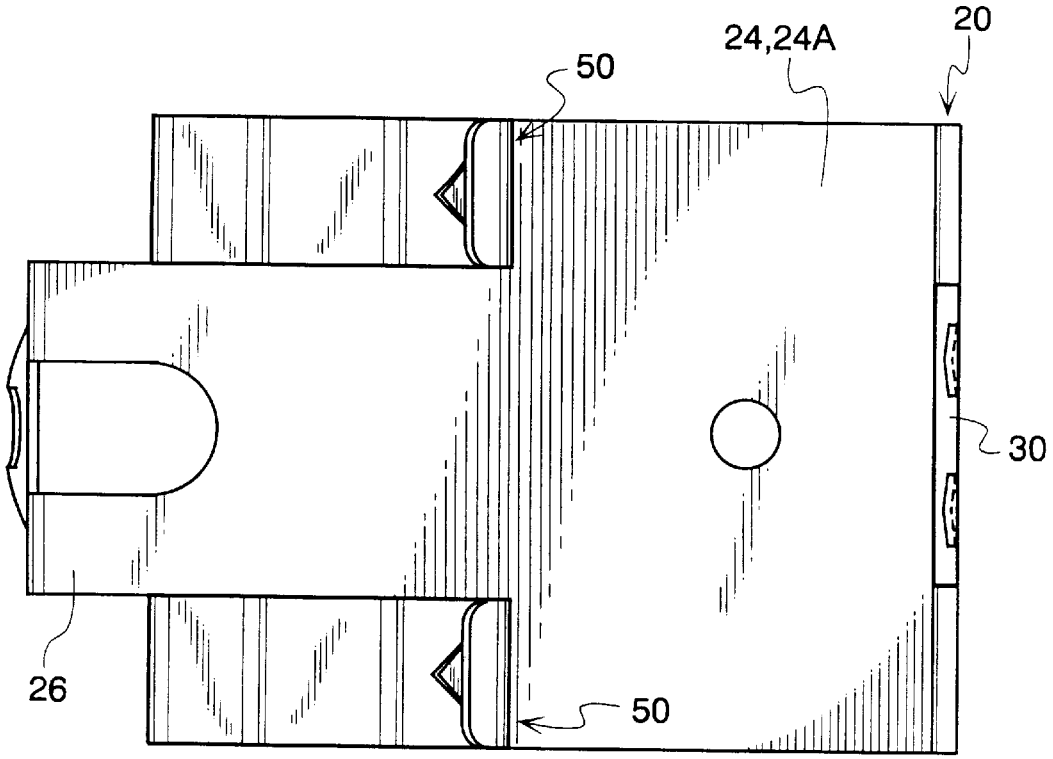
FIG. 3 is a front elevational view thereof.

In the preferred embodiment, as shown in FIG. 3, the spring members 50 are located to either side of main flange 30, although other arrangements are also possible. For example, different numbers and relative sizes of spring members could be used. Also, if the mounting flanges 32 were omitted, the material used to form the optional mounting flanges could remain united with the main flange 30 so as to form a single flange extending the entire height of bracket 20.

Figure 4:
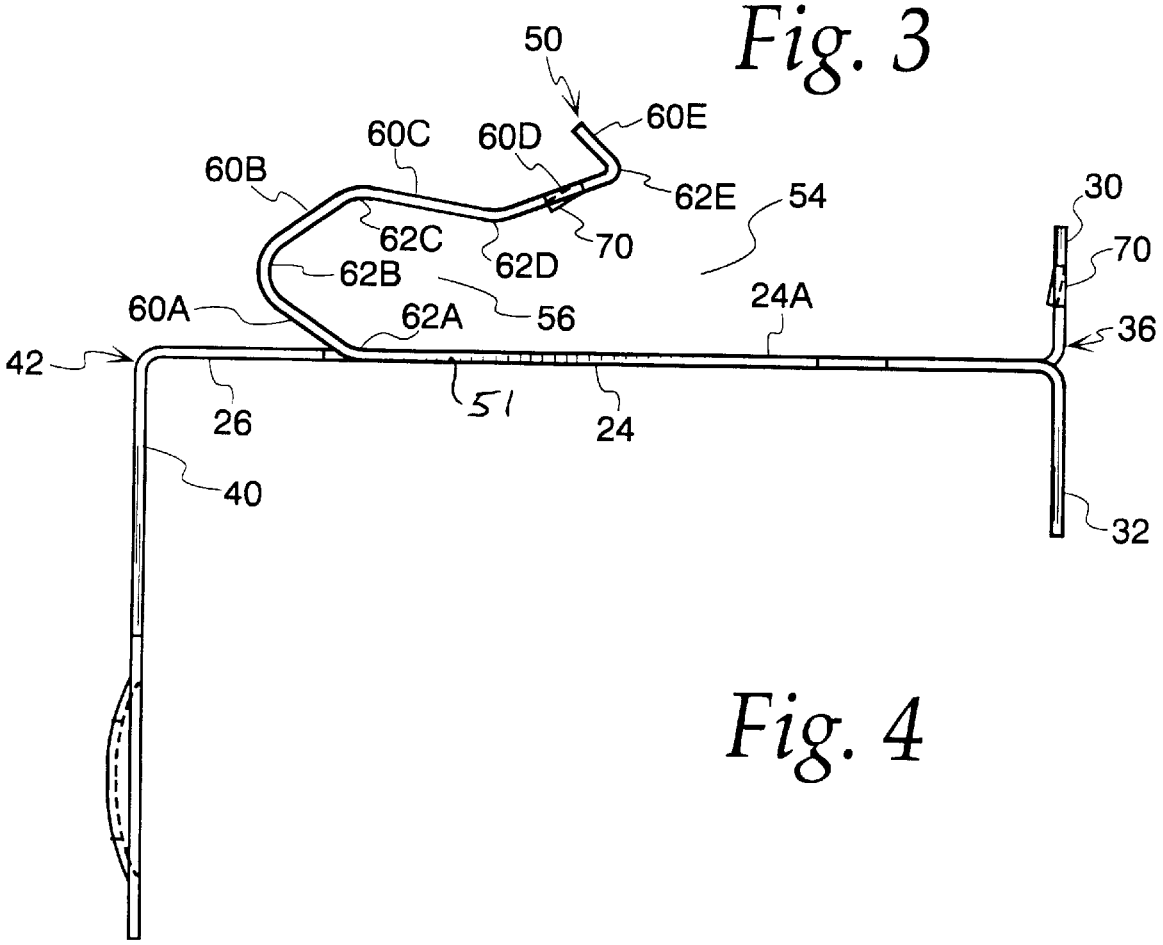
FIG. 4 is a top elevational view thereof.
Figure 8:
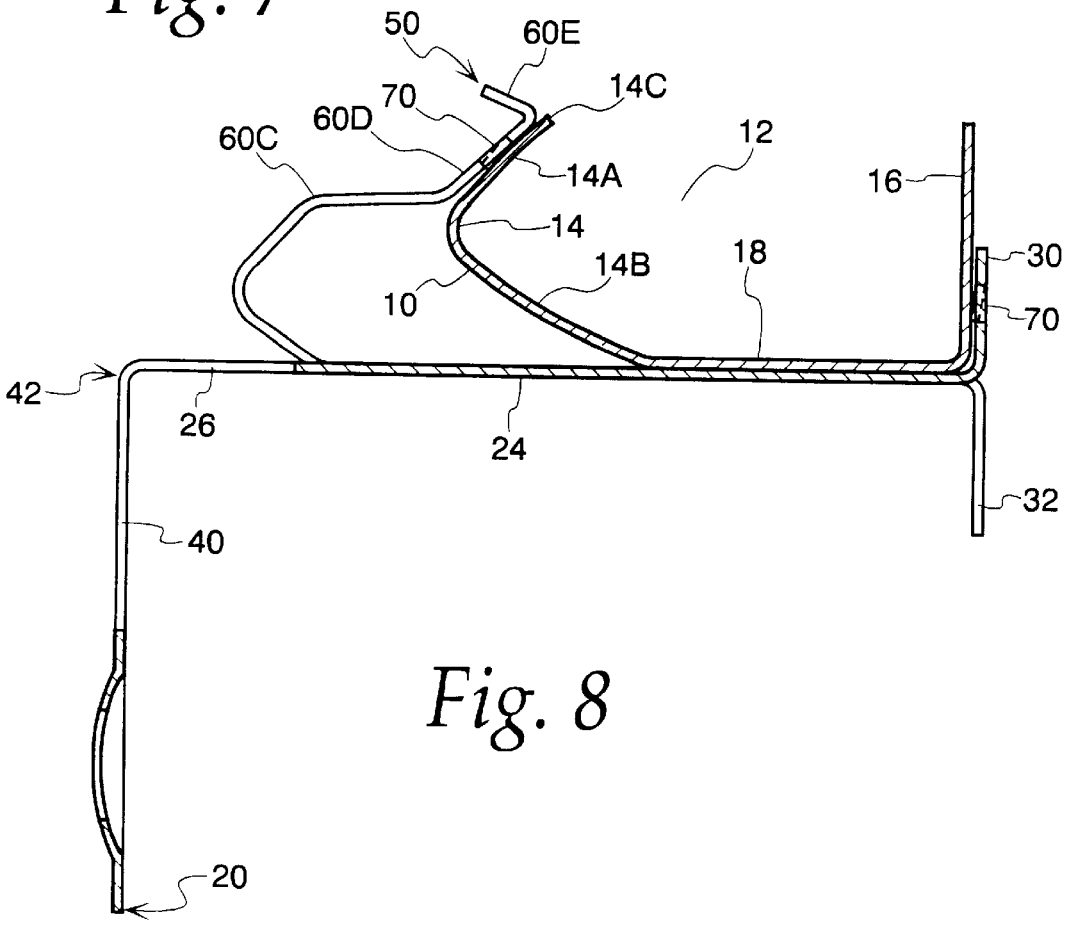
FIG. 8 is a cross-sectional view taken along the line 8—8 of FIG. 7.

As can be seen in FIG. 4, the spring members 50 and main flange 30 cooperate to form a pocket 54 for receiving a garage door track 10 in a manner indicated in FIG. 8. As can be seen, for example, in FIG. 4, the spring members 50 cooperate with arms 51 to form a concave recess 56. In the preferred embodiment, spring member 50 is formed by a succession of generally flat planar portions joined together by rounded bends. As mentioned, the bracket 20 is formed by stamping a blank of spring metal material. By forming the spring members 50 as a serial succession of flat planar portions joined by rounded curves, the spring forces exerted by the bracket on the garage door track can be more readily controlled in a cost effective manner. The particular advantage of bracket 20 is its ability to offer compliance with a range of differently sized and shaped garage door tracks while providing the snap-fit clamping forces desired for secure vibration resistant mounting of the clamp about the garage door track.

Referring again to FIG. 4, the first portion of spring member 50 bent away from its respective arm 51 is designated by reference numeral 60A, and is joined to web portion 24 by a smooth rounded bend or fold 62A. In the preferred embodiment, the angle formed between extension portion 26 and flat portion 60A is approximately 35 degrees. The next portion 60B of spring member 50 is joined to spring portion 60A by a smoothly rounded bend or fold 62B. In the preferred embodiment, the angle between adjacent spring portions 60A, 60B is approximately 70 degrees. Preferably, the spring portions 60A, 60B form a rounded V-shaped recess or crotch facing or opening toward main flange 30. However, as will be seen with reference to FIG. 8, the crotch portion of the preferred embodiment is not placed in nested engagement with the channel 14 of garage door track 10, but is raised a substantial distance above the nearest portion of the garage door track. In the preferred embodiment, contact with the garage door track 10 is made with spring portion 60D coupled to spring portion 60B by an intermediate spring portion 60C. Spring portions 60B, 60C are joined together by a rounded bend 62D. Finally, an end portion 60E is joined to spring portion 60D by an intervening rounded bend portion 62E. As can be seen in FIG. 4, end portion 60E is reversely bent compared to the remainder of the preferred spring member, thus contributing to the overall S-shape of spring member 50.

The angular relationships between the spring portions 60A–60E will now be given with respect to a common reference, the edge of central web portion 24 (i.e. the horizontal direction of FIG. 4). Spring portions 60A, 60B form included angles of 35 degrees with respect to the edge of central web 24. Accordingly, the included angle between web portion 60A, 60B is 70 degrees. Spring portion 60C is inclined at an angle of 10 degrees, and adjacent section 60D forms an included of 20 degrees with respect to the edge of central web 24. Finally, the end portion 60E forms an included angle of 45 degrees with respect to the edge of web portion 24. As mentioned, the spring portions are preferably joined together by intervening rounded bends.

Turning now to FIG. 8, it should be borne in mind that the garage door track 10 illustrated in the figure is but one of several sized and shaped garage door tracks which are accommodated by the same mounting bracket. The channel portion 14 of garage door track 10 has a rounded concave portion formed by an end wall 14A and an adjacent wall 14B which extends from side wall 18. As shown in FIG. 8, the walls 14A, 14B are not flat but are slightly concave. As those skilled in the art will appreciate, garage door track 10 functions as a roller track, receiving rollers rotationally mounted to opposed sides of the garage door, such that the rollers ride in, and the movement is confined by, the walls 14A, 14B of channel portion 14. The mounting for the rollers, not shown in the drawings, extends through slot 12 of track 10 and thus it is desired that the mounting bracket 20 avoid intrusion into the hollow interior 12 of the garage door track. With the arrangement shown in FIG. 8 and the other figures, three areas of contact are made with the garage door track, the area of contact being limited to the outer surfaces of the garage door track. For example, the main flange 30 engages the outer surface of the base 16 of garage door track 10, while the spring members 50 engage the walls 14A of the garage door track. In the preferred embodiment, the central flange 30 extends along a small portion of base 16 while the spring portion 60D is preferably dimensioned so as to avoid extending beyond the edge 14C of the garage door track, and spring portion 60E extends away from slot 12. Thus, interference with the interior of garage door track 10 is avoided.

Figure 2:
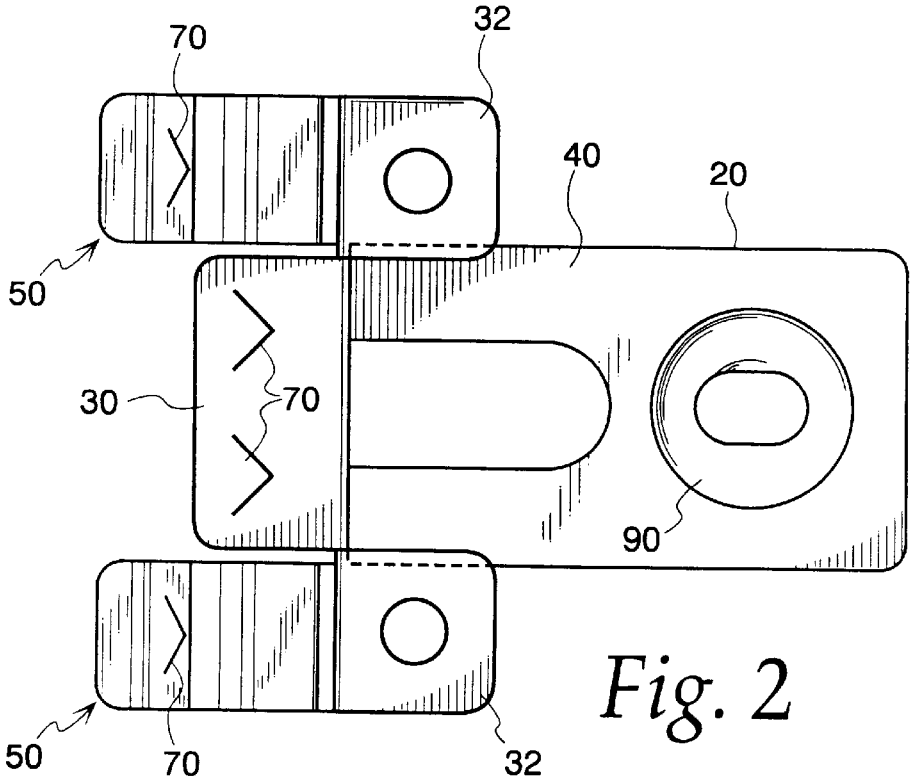
FIG. 2 is a rear elevational view thereof.

Referring now to FIGS. 1 and 2, for example, spring portions 60D and main flange 30 are provided with barbs or claws 70 for biting into the outer surface of garage door track 10. In the preferred embodiment, the barbs 70 have a generally triangular configuration such that the free end of the triangle points toward the major face of web portion 24. Thus, with reference to FIG. 8, for example, the sharp tips of the barbs point in a downward direction, trapping portions of the garage door track between the barbs and the central web 24.

In use, the spring sections 60D are placed in contact with channel section 14A of the garage door track. The main flange 30 is then slid onto base 16. Preferably, the mounting bracket 20 is configured such that the spring member "opens up" as the mounting bracket is fitted on the garage door track, thus storing spring forces within the mounting bracket as it is clamped about the garage door track. As the main flange 30 travels around the corner formed by side wall 18 and base 16 of the garage door track, the spring member of the mounting bracket is allowed to relax somewhat, and the installer experiences a final "snap-fit" engagement as the mounting bracket is fully seated to assume the position illustrated in FIG. 8. As can be seen by comparing FIGS. 4 and 8, the angle of spring section 60C changes with respect to the edge of web portion 24, indicating that the spring members undergo an outward deflection as the mounting bracket is clamped onto the garage door track. By adjusting the relative length of the spring portions 60A–60C, bending forces at the rounded bends 62A–62C can be varied as desired, such that the resultant spring force operating on spring section 60B is applied at a controlled, although preselected angle, to ensure proper biting engagement of the barb 70 with the channel portion 14A.

As mentioned, the barbs 70 have sharpened tips pointing toward web surface 24*a*. In the preferred embodiment, the triangular barbs are stamped from the spring sections 60D and main flange 30 so as to extend toward each other, i.e., toward the center of pocket 54. If desired, other types of barbed structures can be employed. For example, with reference to FIG. 4, holes can be punched in spring section 60D in a generally downward direction such that burrs are formed on the surface of section 60D, which face web surface 24A. Similarly, holes can be punched in center flange 70 of FIG. 4 in a generally left hand direction so as to form burrs which extend toward the spring members 50. The punching operation can be controlled such that the height of the burrs (that is the amount of their extension beyond the surface from which they are struck) is controlled so as to achieve a minimum length, and the shape of the burrs can be controlled so as to successfully withstand shear stresses when wiped across the outer surfaces of track sections 14A and 16. As a further alternative, the clamping member 20 can be pierced so as to form a generally conical rupture, stopping short of forming a hole of appreciable size in the clamping portion. As a further alternative, metal-biting barbs can be provided with conventional clip-on fasteners, typically of spring material, which are slid over the free end of spring member 50 and flange 30.

In order to prevent galling or other biting engagement with the outer surface of track portion 14A, and to ensure complete sealing, the rounded bend portion 62E is provided, and is conveniently formed by bending terminal portion 60E with respect to spring portion 60D. The outer, exposed surface of rounded bend 62E allows the free edge of spring member 50 to freely cam or slide over track portion 14A to aid in positioning clamp member 20 to expand and then snap into engagement with garage door track 10 in the desired manner illustrated in FIG. 8. As the snap-fit clamping engagement with the garage door track is attained, the barbs 70 are brought into biting engagement with outer surfaces of the garage door track. During prototype testing, it was found that configurations of spring member 20 could readily attain reliable snap-fit engagement with a variety of garage door tracks. The biting engagements were sufficient to withstand even determined attempts to remove the mounting bracket. Thus, it can be seen that a simple, reliable fastening arrangement can be achieved without requiring tools or any special training or experience. Further, it will be appreciated that the desired, fully mounted position shown in FIG. 8 can be readily determined by an installer, by monitoring any gap between side wall 18 of the garage door track and central web 24 of mounting bracket 20 and, owing to the spring forces and biting engagement provided, the desired full clamping engagement illustrated in FIG. 8 results in a well-defined orientation of the central web portion 24 with respect to the garage door and garage door opening, the advantage of which will now be discussed.

Figure 6:
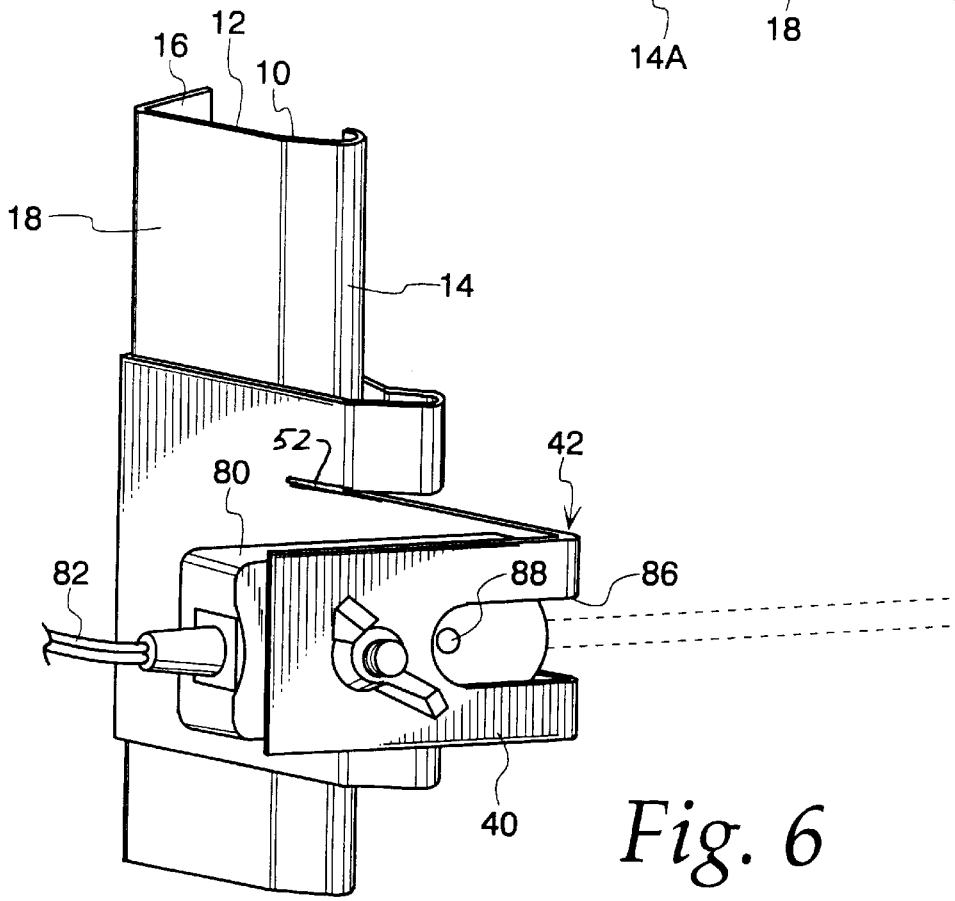
FIG. 6 is another perspective view thereof.

With reference to FIGS. 5 and 6, a beam sensor device 80 having electrical leads 82 is received within housing portion 42 of bracket 20. As can be seen, for example, in FIG. 5, sensor device 80 has a communication port 84 for transmitting and/or receiving an information beam indicated in FIGS. 5 and 6 by dashed lines. Accordingly, a window 86 is cut into extension portion 26 and optionally into leg portion 40 in the manner indicated, thus allowing the information beam to pass through the mounting bracket, while the mounting bracket shrouds or shields the sensor device. As is known in the art, some sensor devices include a status indicator light 88 and, accordingly, window 86 is extended into leg 40 so as to expose the indicator lamp 88.

In the preferred embodiment, leg 40 is provided with a concave recess 90 (see FIGS. 1 and 2) to receive a conventional convex button or protrusion 92 to provide a ball-and-socket mounting of device 80 to the bracket 20. As indicated in FIG. 5, a wing nut fastener 94 engages a threaded stud 96 which extends from sensor 80 in a known manner. As wing nut fastener 94 is tightened, alignment of device 80 is fixed with respect to mounting bracket 20. It is generally preferred that the surfaces of housing portion 42 be relied upon to provide tactile and visual orientation of beam sensor device 80 with respect to mounting bracket 20, thus simplifying the installation procedure.

If desired, the sensor could be positioned against the opposite face of leg 40 and could, in this instance, be provided with a concave recess so as to receive the protruding surface of concave recess 90 (see FIG. 2). Of course, the recess 90 could be reversed in direction from that shown in the drawings so as to accommodate a detector device having a convex protrusion surrounding its associated mounting stud.

As mentioned above, the position of web section 24 is well defined by the full clamping engagement illustrated in FIG. 8. Accordingly, the angle of orientation of the beam sensor device 80 with respect to the garage door track is readily fixed as the beam sensor device 80 is installed and wing nut fastener 94 is tightened. In use, a pair of beam sensor devices are typically employed for each garage door opening, it being important that the beam sensor devices are positioned such that the information beamed between them is colinearly aligned with the device ports 84. In such arrangements, one beam sensor device comprises a transmitter while the other beam sensor device comprises a receiver. In the preferred embodiment, the sensor beam is comprised of infrared energy, although other types of conventional sensor beams can be employed, if desired. As a further alternative, a combined transmitter/receiver unit can be mounted on one bracket 20, and a mirror surface can be provided or mounted on a second bracket or wall surface located adjacent the opposite side of the garage door opening. The bracket of the present invention has been found to provide a mounting which is vibration resistant so as to avoid coming loose despite repeated operations of the garage door and so as to hold the beam steady across the garage door opening, even while the garage door is being operated.

As will be appreciated from examining FIGS. 5 and 6, the beam sensor device 80 is shielded by the housing portion 42 of the mounting bracket, and is thus protected against damage caused by inadvertent contact. Further, the housing portion 42 is located at one end of central web portion 24 which further functions as a cantilever spring finger allowing the housing portion to be temporarily deflected while experiencing inadvertent contact, restoring the housing portion to its desired, precise alignment when the inadvertent contact is removed.

Figure 7:
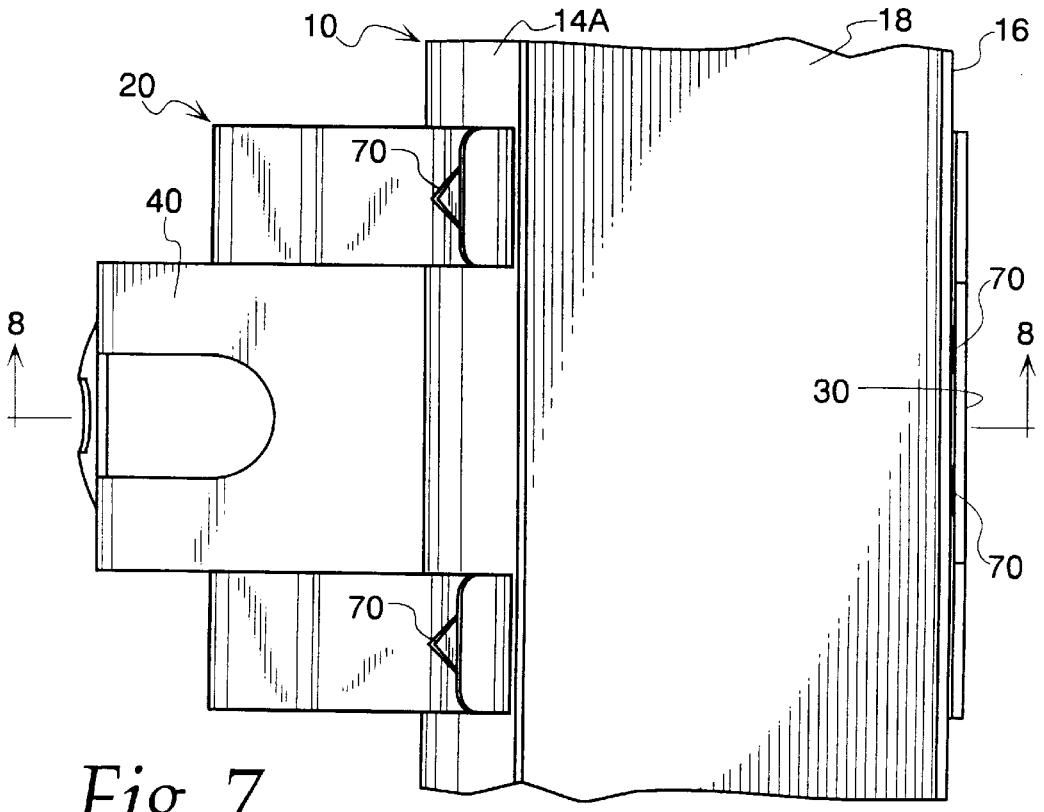
FIG. 7 is a side elevational view thereof.

Referring to FIG. 7, the main flange 30 is aligned in close contact with the base 16 of the garage door track 10. Prototype examples have clearly shown that it is very difficult to dislodge mounting bracket 20 from its desired orientation shown in FIG. 7, by inadvertent contact forces applied to the mounting bracket in an upward or downward direction. The stability of the mounting bracket when securely clamped about the garage door track is remarkable. Even upon application of a very substantial dislodging force, even those applied in a vertical direction, only a very slight dislocation of the mounting bracket with respect to the garage door track is experienced, typically resulting in an angular dislodgement of only one or two degrees between central bracket 30 and base 16 of the garage door track. This angular dislodgement is readily apparent when viewing the assembly from the perspective shown in FIG. 7 and a modest amount of dislocation can be readily removed by restoring the generally parallel orientation shown at the right hand portion of FIG. 7. For lighter, more usual dislocation forces, the spring energy stored in mounting bracket 20 is sufficient to quickly restore the desired alignment illustrated in FIG. 7, upon removal of the inadvertent contact force.

Figure 9:
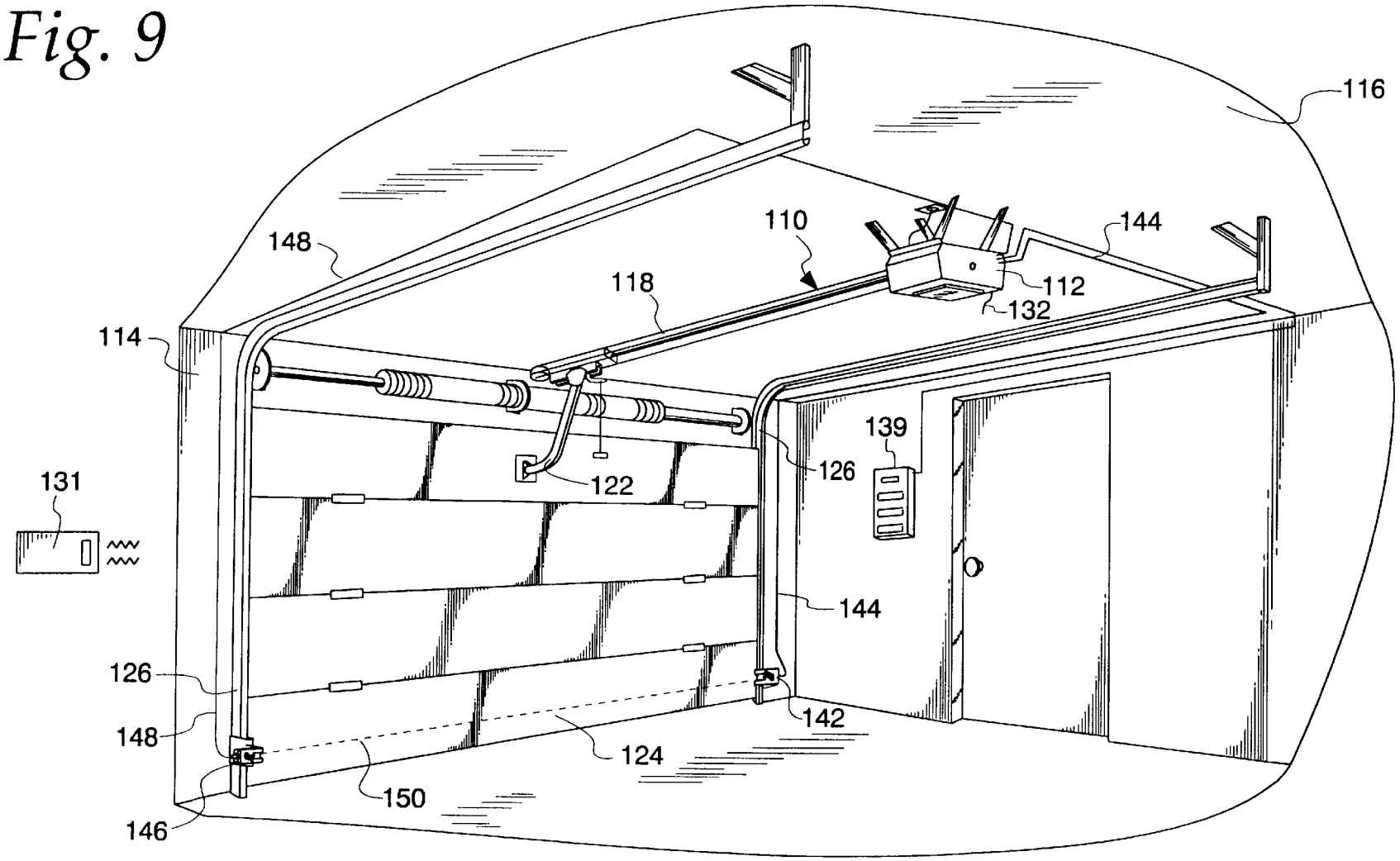
FIG. 9 is a perspective view of a garage door installation employing mounting apparatus according to the principles of the present invention.

Referring now to FIG. 9, installation of the aforementioned mounting brackets will now be described with reference to a conventional garage door control system generally indicated at 110, shown mounted in a garage having a wall 114 and a ceiling 116. A garage door 124 is mounted on tracks 126, which in turn are attached to wall 114 and ceiling 116 in a conventional manner. A conventional drive track 118 is mounted between a drive motor chassis 112 and wall 114. A motor in chassis 112 drives a drive chain along drive track 118, in opposite directions. An operator arm 122 has one end attached to the drive chain and a second end attached to garage door 124. When the motor in chassis 112 is energized, door arm 122 travels back and forth along drive track 118, raising and lowering garage door 124. For example, in a door opening mode, the drive chain is placed under tension so as to pull operator arm 122 toward the motor chassis 112. This accordingly creates a pulling force at the upper end of garage door 124, causing rollers attached to the garage door to be pulled along in tracks 126 as the garage door is raised, i.e., drawn toward motor chassis 112.

Chassis 112, as is known in the art, contains a number of control systems pertaining to operation of the garage door. Equipment within chassis 112 receives commands for the garage door operation. For example, a push button control unit 139 is mounted within the garage and transmits control signals through conductors 144 to chassis 112 to either open or close the garage door or to perform other functions, as desired. In the embodiment shown, chassis 112 includes a radio receiver (not shown) receiving signals from an antenna 132. A radio transmitter 131 sends coded signals to the antenna 132, and can, for example, duplicate commands issued by push button control panel 139. According to the commands issued to control circuitry within chassis 112, garage door 124 may be either opened or closed. During closing of the garage door, an obstruction may be present in the path of garage door travel. It is known to provide automatic reversing protection by sensing, for example, the amount of torque required to complete an unsuccessful garage door closing attempt. However, recognizing that the obstruction may be caused by a child, or a household pet, for example, a more rapid control intervention may be desired. Accordingly, a pair of sensor devices 142, 146 are provided on either side of garage door 124. The sensor devices are coupled through conductors 144, 148 to chassis 112. The detector devices 142, 146 transmit a detection beam 150, between them. If the detection beam 150 should be broken, the event is interpreted as an obstruction and corresponding obstruction signals are communicated to the control chassis 112 to take appropriate action, preferably stopping any downward movement of the garage door. Of course, the signals from detector devices 142, 146 could be used in other ways.

Thus, it can be seen that a mounting bracket is provided which can be quickly and readily mounted to a series of differently sized and shaped structural members without requiring tools or special knowledge or training. Although garage door tracks have been considered above, the mounting bracket described above could also be used with other support members having opposed rounded and flat ends. For example, automatic gate controls and intrusion alarms could be mounted on fence posts using the mounting bracket of the present invention. The mounting of the bracket to the garage door track is exceptionally stable and successfully withstands substantial inadvertent contact forces. Spring energy stored in the mounting bracket during attachment to the garage door track results not only in stable beam alignment, but also in the rapid and automatic restoration of the desired alignment of the mounting bracket with respect to the garage door track upon removal of inadvertent contact forces. Further, the housing portion of the mounting bracket shields the beam sensor device from direct contact while providing a spring mounting for the beam sensor device to quickly restore its desired alignment should contact forces be inadvertently applied to the housing portion.

The drawings and the foregoing description are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A bracket for mounting an IR detector device for garage door safety to the exterior of a track for a garage door without interfering with running of rollers in the track, comprising:

a main web portion having a lip portion attached at one end and adapted for engaging and being supported by an exterior edge of the track;

a substantially curvingly-shaped spring member attached at the other end of the web portion and bent so as to face opposite the lip portion for resiliently engaging an opposite exterior edge of the track and for snap fitting the bracket to the track without interfering with running of rollers in the track; and a safety device mounting extension member attached at an angle to the web portion for positioning the IR detector device such that the IR detector device has a line of sight across a garage door opening, the extension member extending in a direction opposite from the spring member and the lip portion.

2. The bracket of claim 1, wherein the serpentine-shaped spring member includes a claw extending from a surface facing the lip portion for engaging and biting into the exterior surface of the track for providing secure vibration resistant mounting of the bracket to the track.

3. The bracket of claim 2, wherein the serpentine-shaped spring member comprises a flat portion which angles slightly away from the web portion, wherein a bending force of the spring member is substantially dependent on the relative length of the spring member and wherein the claw extends from the flat portion.

4. The bracket of claim 1, wherein the lip portion includes a claw extending from a surface facing the other end of the main web for engaging and biting into the exterior surface of the track.

5. The bracket of claim 1, wherein the lip portion is formed at a substantially right angle to the web portion.

6. The bracket of claim 1, wherein the mounting member is formed at a substantially right angle to the web portion.

7. The bracket of claim 1, wherein the S-shaped spring member comprises a pair of substantially S-shaped spring members attached to from the web portion.

8. The bracket of claim 1, further comprising first and second apertures for receiving threaded fasteners for enabling alternate installation of the bracket on a structure other than the track.

9. The bracket of claim 1, wherein the extension member comprises a dish-shaped depressed portion for receiving the safety device.

10. The bracket of claim 9, wherein the extension member comprises a housing portion enclosing a portion of the safety device for providing shrouding or shielding from inadvertent contact.

11. A bracket for mounting an IR detector device for garage door safety to the exterior of a track for a garage door without interfering with running of rollers in the track, comprising:

a main web portion having a lip portion formed at one end and adapted for engaging and being supported by an exterior edge of the track;

a substantially curvingly-shaped spring member formed at the other end of the web portion and bent so as to face opposite the lip portion for resiliently engaging an opposite exterior edge of the track and for snap fitting the bracket to the track without interfering with running of rollers in the track; and a safety device mounting extension member extending at an angle from the web portion for positioning the IR detector device such that the IR detector has a line of sight across a garage door opening, the extension member extending in a direction opposite from the spring member and the lip portion.

* * * * *